US005408993A

United States Patent [19]

Gomez et al.

[11] Patent Number: 5,408,993

[45] Date of Patent: Apr. 25, 1995

[54] SNORKEL AND BUOYANCY VEST WITH MANUAL CONTROLS

[76] Inventors: Miguel R. Gomez, 7022 Sunset Ave., Panama City Beach, Fla. 32408; Rommie H. Brock, 2639 Ferol La., Lynn Haven, Fla. 32444

[21] Appl. No.: 86,030

[22] Filed: Jul. 6, 1993

[51] Int. Cl.[6] ..... B63C 11/08

[52] U.S. Cl. ..... 128/202.14; 128/201.26; 128/201.27; 128/201.28; 128/200.24; 441/88

[58] Field of Search ..... 128/201.11, 201.26, 128/201.27, 201.28, 200.24, 200.29, 202.14; 441/88, 135, 124, 114–118; 405/186

[56] References Cited

U.S. PATENT DOCUMENTS 3,138,155 6/1964 Bould ..... 405/186
5,101,818 4/1992 Chace et al. ..... 128/202.14

*Primary Examiner*—Edgar S. Burr
*Assistant Examiner*—William J. Deane, Jr.

[57] ABSTRACT

A new and improved snorkel and buoyancy control apparatus includes a snorkel tube for receiving inhaled air, a first one-way air valve connected to the snorkel tube for permitting air flow into the snorkel tube during inhalation, and a mouthpiece for receiving inhaled air and for supplying the inhaled air to the snorkeler's mouth and lungs. The mouthpiece includes a mouthpiece output port for permitting exhaled air to exit from the snorkeler's mouth. A second one-way air valve is connected to the mouthpiece for permitting air flow from the mouthpiece to a selector valve assembly. The selector valve assembly, connected to the mouthpiece by way of the second one-way air valve, receives exhaled air from the mouthpiece and selectively directs exhaled air to either a first selector valve output port connected to a vent or to a second selector valve output port connected to a buoyancy control vest which includes a first port connected to the selector valve assembly. Air directed to the buoyancy control vest is used to inflate the buoyancy control vest. The selector valve assembly may also include a mode for connecting the buoyancy control vest to the vent to deflate the buoyancy control vest.

8 Claims, 5 Drawing Sheets

SNORKEL AND BUOYANCY VEST WITH MANUAL CONTROLS

BACKGROUND OF THE INVENTION

1. Field of the Invention

The present invention relates generally to snorkels and more particularly, to a snorkel device especially adapted for inflation of a buoyancy control vest.

2. Description of the Prior Art

Snorkels are well known in the art. In a typical snorkel device, air is inhaled through a snorkel tube into a person's mouth. Exhaled air is exhausted to the water or the air.

To facilitate flotation of a person who is snorkeling or who has finished snorkeling, a buoyancy control vest is often worn. The buoyancy control vest is inflated with air. When more buoyancy is desired, more air is forced into the buoyancy control vest. Alternatively, when less buoyancy is desired, some air is let out of the buoyancy control vest.

Typically, when a person is finished snorkeling, the person rises to the surface of the water, removes the snorkel from his/her mouth and inflates the buoyancy control vest with more air to facilitate the person's floating high in the water. This sequence of events is often a cause of discomfort for the snorkeler. Not only must the snorkel be removed from the snorkeler's mouth, but the snorkeler must actuate a valve on the buoyancy control vest and begin blowing on the buoyancy control vest as the snorkeler is treading water. The snorkeler must also risk the possibility of choking on accidentally swallowed water while transferring the mouth from the snorkel to the vest and during subsequent exhalations to the the vest while near the surface of the water. In addition, the snorkeler must use the first exhalation to clear the snorkel, at a time when the additional buoyancy is desired.

In this respect, it would be desirable if a device were provided which enabled inflation of the buoyancy control vest without requiring the snorkeler to remove the snorkel from his/her mouth and thereby losing a more secure water seal. In addition, it would be desirable if a device were provided that permitted the person to inflate the buoyancy control vest without blowing up the buoyancy control vest as the person is treading water with the snorkel out of the mouth. It would also be desirable if a device were provided which allowed the snorkeler to direct the first exhalation to the buoyancy compensator upon surfacing without requiring the snorkeler to first clear the snorkel and thus temporarily lose wanted buoyancy. In addition, it would be desirable if a device were provided which enabled the snorkeler to acquire air for inflation of the vest from the top of the snorkel which is approximately 12 inches above the water instead of through the open mouth which would be near the water surface.

As mentioned above, the buoyancy control vest is used by the snorkeler as the person is snorkeling. Yet making changes in the inflation of the buoyancy control vest during snorkeling is not contemplated in the prior art. Changes in the inflation of the buoyancy control vest must be made either before or after snorkeling, but not during snorkeling. In this respect, it would be desirable if a device were provided that enabled a snorkeler to change the inflation of the buoyancy control vest during the snorkeling operation.

The following U.S. patents have been uncovered which relate to buoyancy control vests: U.S. Pat. Nos. 3,512,196; 4,035,857; 4,379,656; and 5,020,941. In these vests, either the vest is inflated by a user by direct mouth contact on the vest, or the vest is inflated by pressurized air such as used in scuba diving equipment. In this respect, it would be desirable if a device were provided that enabled inflation of buoyancy control vests without direct mouth contact on the vest and thereby reduce the chance of choking on water accidentally ingested while quickly trying to inflate the buoyancy control vest. Moreover, a person who is snorkeling is not generally wearing scuba diving equipment. In this respect, it would be desirable if a device were provided that enabled inflation of a buoyancy control vest without a pressurized tank such as used in scuba diving equipment.

Thus, while the foregoing body of prior art indicates it to be well known how to snorkel and to use buoyancy control vests, the prior art described above does not teach or suggest a snorkel and buoyancy control apparatus which has the following combination of desirable features: (1) enables inflation of the buoyancy control vest without requiring the snorkeler to remove the snorkel from his/her mouth and thereby preventing choking on accidentally swallowed water; (2) enables to snorkeler to acquire air for inflation of the buoyancy control vest from a position elevated from the water surface; (3) avoids the necessity of the person inflating the buoyancy control as the person is treading water with the snorkel out of the mouth; (4) enables a snorkeler to use the first exhalation upon surfacing to aid in flotation; (5) enables a snorkeler to change the degree of inflation of the buoyancy control vest during the snorkeling operation; (6) enables inflation of buoyancy control vest without direct mouth contact on the vest; and (7) enables inflation of a buoyancy control vest without a pressurized tank such as used in scuba diving equipment. The foregoing desired characteristics are provided by the unique snorkel and buoyancy control apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved snorkel and buoyancy control apparatus which includes a snorkel tube for receiving inhaled air, a first one-way air valve connected to the snorkel tube for permitting air flow into the snorkel tube during inhalation, and a mouthpiece for receiving inhaled air and for supplying the inhaled air to the snorkeler's mouth and lungs. The mouthpiece includes a mouthpiece output port for permitting exhaled air to exit from the snorkeler's mouth. A second one-way air valve is connected to the mouthpiece for permitting air flow from the mouthpiece to a selector valve assembly. The selector valve assembly, connected to the mouthpiece by way of the second one-way air valve, receives exhaled air from the mouthpiece and selectively directs exhaled air to either a first selector valve output port connected to a vent or to a second selector valve output port connected to a buoyancy control vest which includes a first port connected to the selector valve assembly. Air directed to the buoyancy control vest is used to inflate the buoyancy control vest. The selector valve assembly may also include a mode for connecting the buoyancy control vest to the vent to deflate the buoyancy control vest.

The selector valve assembly may further include a third selector valve output port and a second manually actuated output port selector; and the buoyancy control vest may further include a second port. The second port of the buoyancy control vest is connected to the third selector valve output port, and the second manually actuated output port selector controls flow of air from the buoyancy control vest to the first selector valve output port and the vent for deflating the buoyancy control vest.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved snorkel and buoyancy control apparatus which has all of the advantages of the prior art and none of the disadvantages.

It is another object of the present invention to provide a new and improved snorkel and buoyancy control apparatus which may be easily and efficiently manufactured and marketed.

It is a further object of the present invention to provide a new and improved snorkel and buoyancy control apparatus which is of durable and reliable construction.

It is still a further object of the present invention to provide a new and improved snorkel and buoyancy control apparatus which has low maintenance and easy cleaning needs such as is not available with $CO_2$ cartridges or with pressurized tanks such as used in scuba diving equipment which require special training.

An even further object of the present invention is to provide a new and improved snorkel and buoyancy control apparatus which is susceptible of a low cost of manufacture with regard to both materials and labor, and which accordingly is then susceptible of low prices of sale to the consuming public, thereby making such snorkel and buoyancy control apparatus available to the buying public.

Still yet a further object of the present invention is to provide a new and improved snorkel and buoyancy control apparatus which enables inflation of a buoyancy control vest without requiring the snorkeler to remove the snorkel from his/her mouth.

Still another object of the present invention is to provide a new and improved snorkel and buoyancy control apparatus which enables a snorkeler to acquire air for inflation of the buoyancy control apparatus from an elevation above the water surface level.

Still another object of the present invention is to provide a new and improved snorkel and buoyancy control apparatus which permits a person to avoid inflating the buoyancy control vest as the person is treading water with the snorkel out of the mouth.

Still a further object of the present invention is to provide a new and improved snorkel and buoyancy control apparatus which enable a snorkeler to direct the first exhaled air upon surfacing to the buoyancy control vest to aid in flotation.

Yet another object of the present invention is to provide a new and improved snorkel and buoyancy control apparatus which enables a snorkeler to change the inflation of the buoyancy control vest during the snorkeling operation.

Even another object of the present invention is to provide a new and improved snorkel and buoyancy control apparatus which enables inflation of a buoyancy control vest without direct mouth contact on the vest.

Still a further object of the present invention is to provide a new and improved snorkel and buoyancy control apparatus which enables inflation of a buoyancy control vest without using a pressurized tank such as used in scuba diving equipment.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENTS

Figure 1:
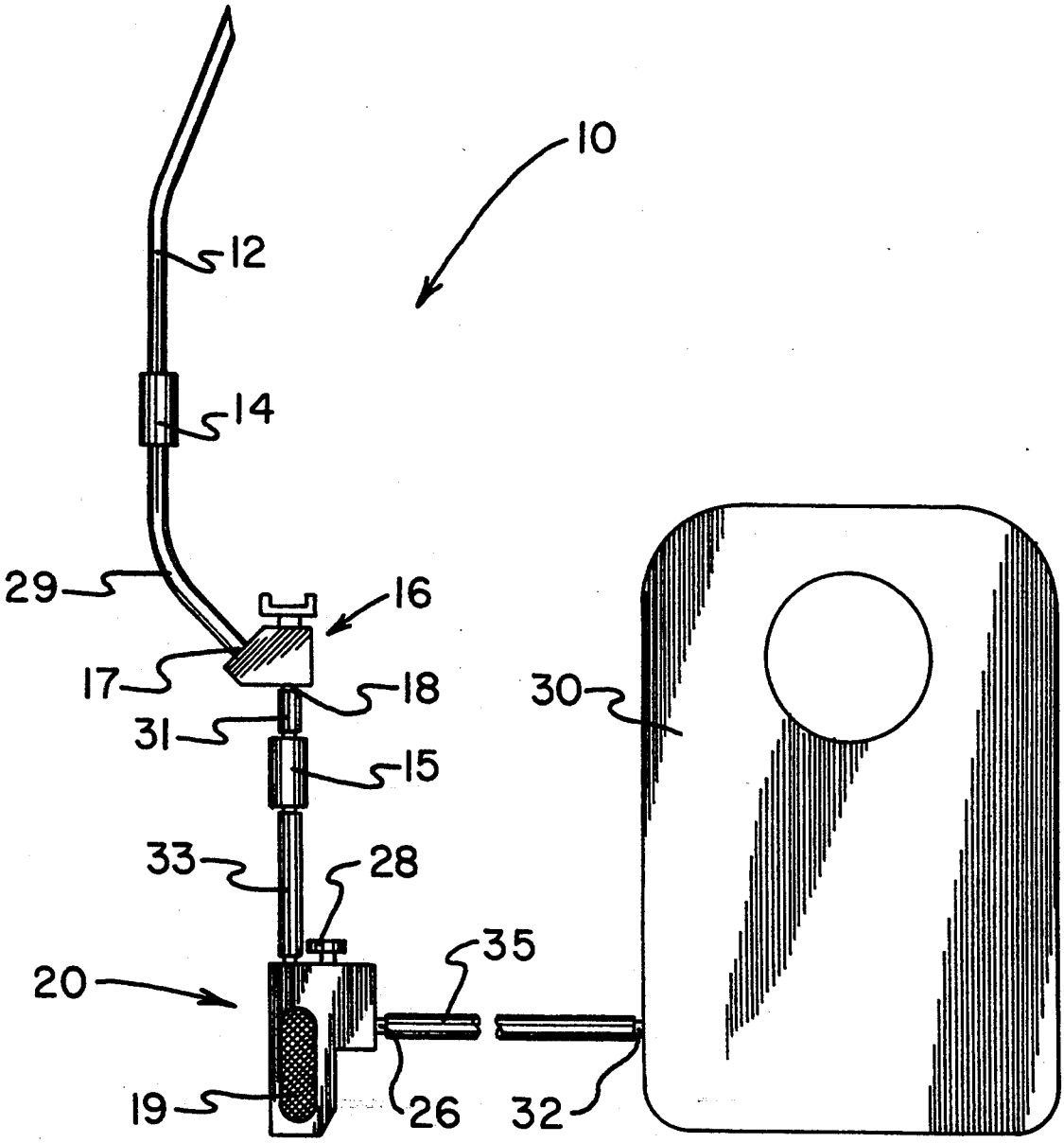
FIG. 1 is an elevational view showing a first preferred embodiment of the snorkel and buoyancy control apparatus of the invention.

With reference to the drawings, a new and improved snorkel and buoyancy control apparatus embodying the principles and concepts of the present invention will be described.

Turning initially to FIGS. 1–4, there is shown a first exemplary embodiment of the snorkel and buoyancy control apparatus of the invention generally designated by reference numeral 10. In its preferred form, the snorkel and buoyancy control apparatus 10 includes a snorkel tube 12 for receiving air inhaled by the snorkeler, a first one-way air valve 14 connected to the snorkel tube 12 for permitting air flow into the snorkel tube 12 during inhalation, and a mouthpiece 16 for receiving inhaled air and for supplying the inhaled air to the snorkeler's mouth and lungs. A tube 29 is used to connect the first one-way air valve 14 to the mouthpiece 16. The mouthpiece 16 includes a mouthpiece output port 18 for permitting exhaled air to exit from the snorkeler's mouth. A second one-way air valve 15 is connected to the mouthpiece 16 for permitting air flow frown the mouthpiece 16 to a selector valve assembly 20. A tube 31 is used to connect the mouthpiece output port 18 to second one-way air valve 15.

The selector valve assembly 20, connected to the mouthpiece 16 by way of the second one-way air valve 15, receives exhaled air from the mouthpiece 16 and selectively directs exhaled air to either a vent 19 or to a buoyancy control vest 30 for inflation thereof. The buoyancy control vest 30 which includes a first port 32 is connected to the selector valve assembly 20 by tube 35.

The mouthpiece 16 includes a mouthpiece input port 17 connected to the snorkel tube 12 by way of the first one-way air valve 14 and also includes a mouthpiece output port 18 for permitting exhaled air to exit from the snorkeler's mouth.

The second one-way air valve 15 is connected to the mouthpiece output port 18, for permitting air flow from the mouthpiece output port 18 to the selector valve assembly 20. The selector valve assembly 20 is connected to the mouthpiece output port 18 by way of the second one-way air valve 15.

The selector valve assembly 20 includes a selector valve input port 22, a first selector valve output port 24, a second selector valve output port 26, and a first manually actuated output port selector 28. The selector valve input port 22 is connected to the mouthpiece output port 18 by way of the second one-way air valve 15. A tube 33 is used to connect the second one-way air valve 15 to the selector valve input port 22.

The first selector valve output port 24 is vented to outside the selector valve assembly 20 through a vent 19. The second selector valve output port 26 is connected to a buoyancy control vest 30 by way of a first port 32 connected to the second selector valve output port 26. A tube 35 is used to connect the second selector valve output port 26 to the first port 32.

Figure 2:
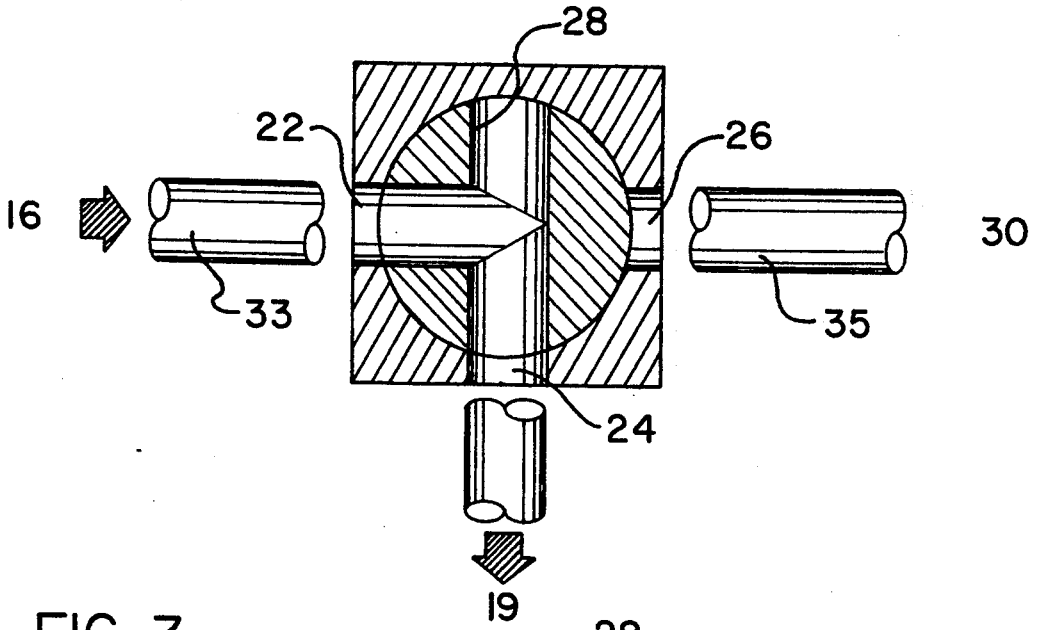
FIG. 2 is a schematic air flow diagram for the selector valve assembly in the embodiment in FIG. 1 in a position connecting exhaled air from the mouthpiece to the vent.
Figure 3:
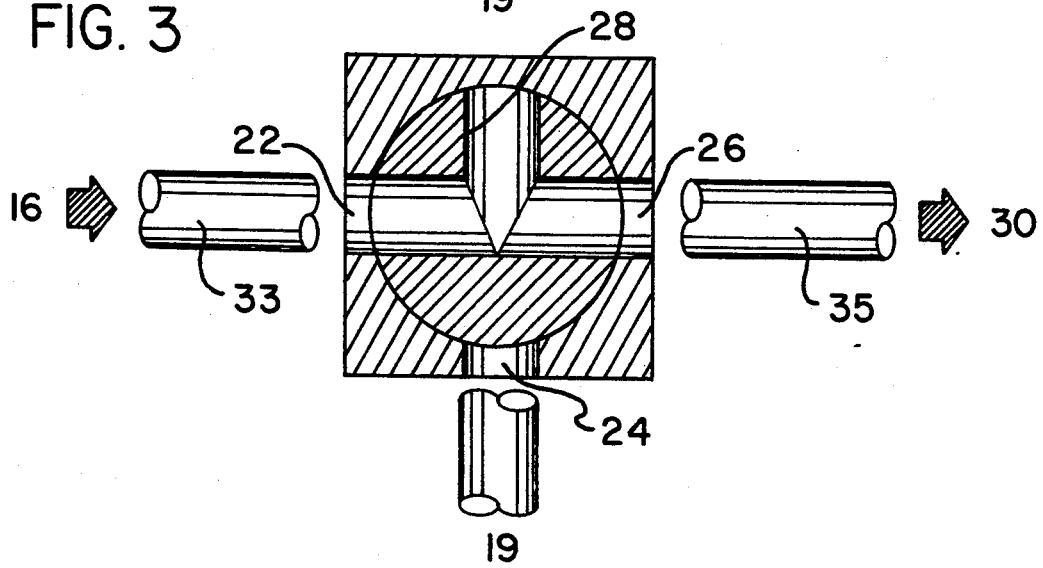
FIG. 3 is a schematic air flow diagram for the selector valve assembly in the embodiment in FIG. 1 in a position connecting exhaled air from the mouthpiece to the buoyancy control vest to inflate the buoyancy control vest.
Figure 4:
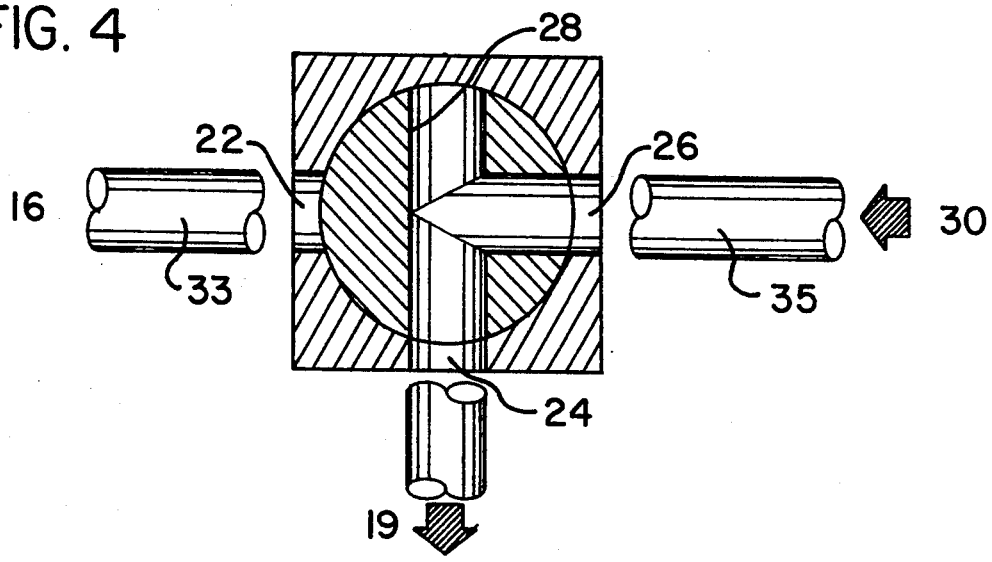
FIG. 4 is a schematic air flow diagram for the selector valve assembly in the embodiment in FIG. 1 in a position connecting air from the buoyancy control vest to the vent to deflate the buoyancy control vest.

A detailed explanation of the operation of the first embodiment of the snorkel and buoyancy control apparatus 10 of the invention shown in FIG. 1 is provided with references to the air flow diagrams shown in FIGS. 2–4.

In FIG. 2, a T-shaped first manually actuated output port selector 28 is shown in a first position wherein exhaled air from the mouthpiece 16 is directed to the vent 19. In the position shown in FIG. 2, the state of inflation of the buoyancy control vest 30 is maintained.

In FIG. 3, the first manually actuated output port selector 28 is shown in a second position wherein exhaled air from the mouthpiece 16 is directed to the buoyancy control vest 30 for inflation thereof.

In FIG. 4, the first manually actuated output port selector 28 is shown in a third position wherein air inside the buoyancy control vest 30 is directed to the vent 19 for deflation of the buoyancy control vest 30. In this position of the first manually actuated output port selector 28, the snorkeler would either be inhaling or momentarily holding one's breath but not be exhaling.

Turning to FIGS. 5–10, a second embodiment of the invention is shown. Reference numerals are shown that correspond to like reference numerals that designate like elements shown in the other figures. In addition, the selector valve assembly 20 further includes a third selector valve output port 34 and a second manually actuated output port selector 38. The buoyancy control vest 30 further includes a second port 36. The second port 36 is connected to the third selector valve output port 34. A tube 37 is used to connect third selector valve output port 34 with second port 36. The second manually actuated output port selector 38 controls flow of air from the buoyancy control vest 30 to the first selector valve output port 24 and the vent 19 for deflating the buoyancy control vest 30.

Figure 5:
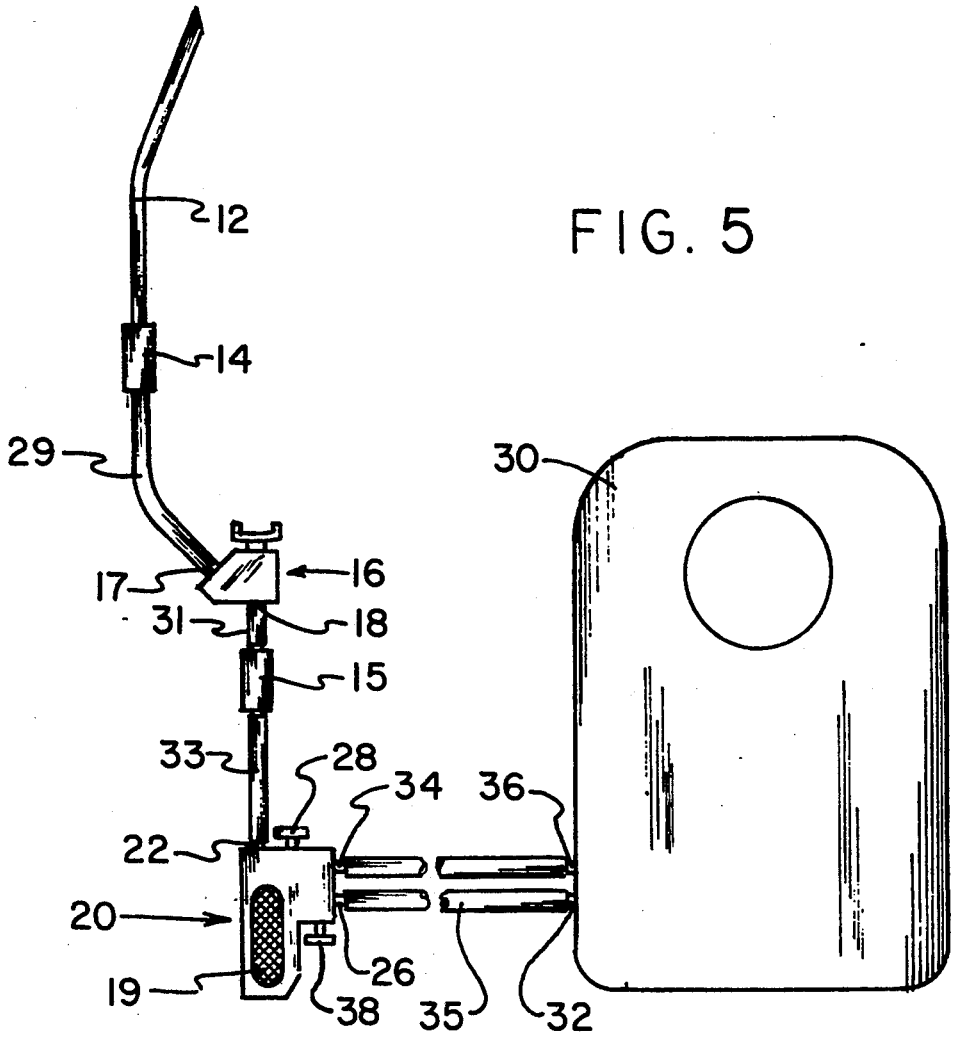
FIG. 5 is an elevational view showing a second preferred embodiment of the snorkel and buoyancy control apparatus of the invention.

A detailed explanation of the operation of the second embodiment of the snorkel and buoyancy control apparatus 10 of the invention shown in FIG. 5 is provided with references to the air flow diagrams shown in FIGS. 7–10.

Figure 6:
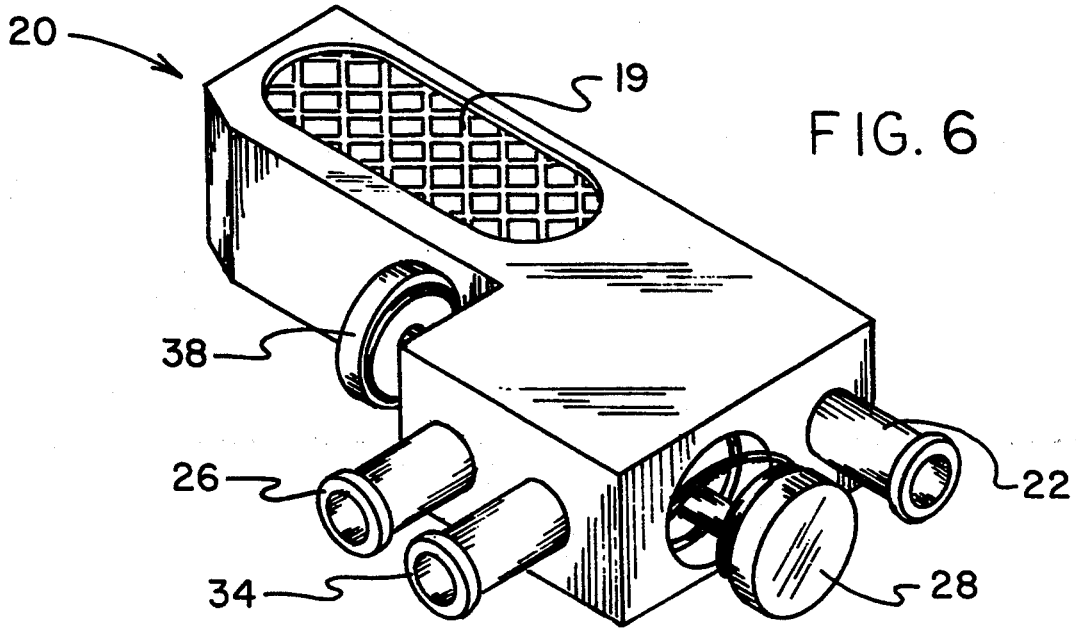
FIG. 6 is an enlarged perspective view of a selector valve assembly used in the embodiment of the invention shown in FIG. 5.

It is noted that the arrangement of the first manually actuated output port selector 28 and the second manually actuated output port selector 38 shown in FIGS. 5 and 6 is slightly different from the corresponding arrangement in FIGS. 7–10. This difference is inconsequential. The linear arrangement of the first manually actuated output port selector 28 and second manually actuated output port selector 38 in FIGS. 7–10 is provided for purposes of simplicity and ease of understanding.

In FIGS. 7–10, the first manually actuated output port selector 28 and the second manually actuated output port selector 38 are shown to be spring-biased linear valves. The first manually actuated output port selector 28 includes two valve elements for controlling two air channels 21 and 23, respectively. The second manually actuated output port selector 38 includes one valve element for controlling the air channel 21.

Figure 7:
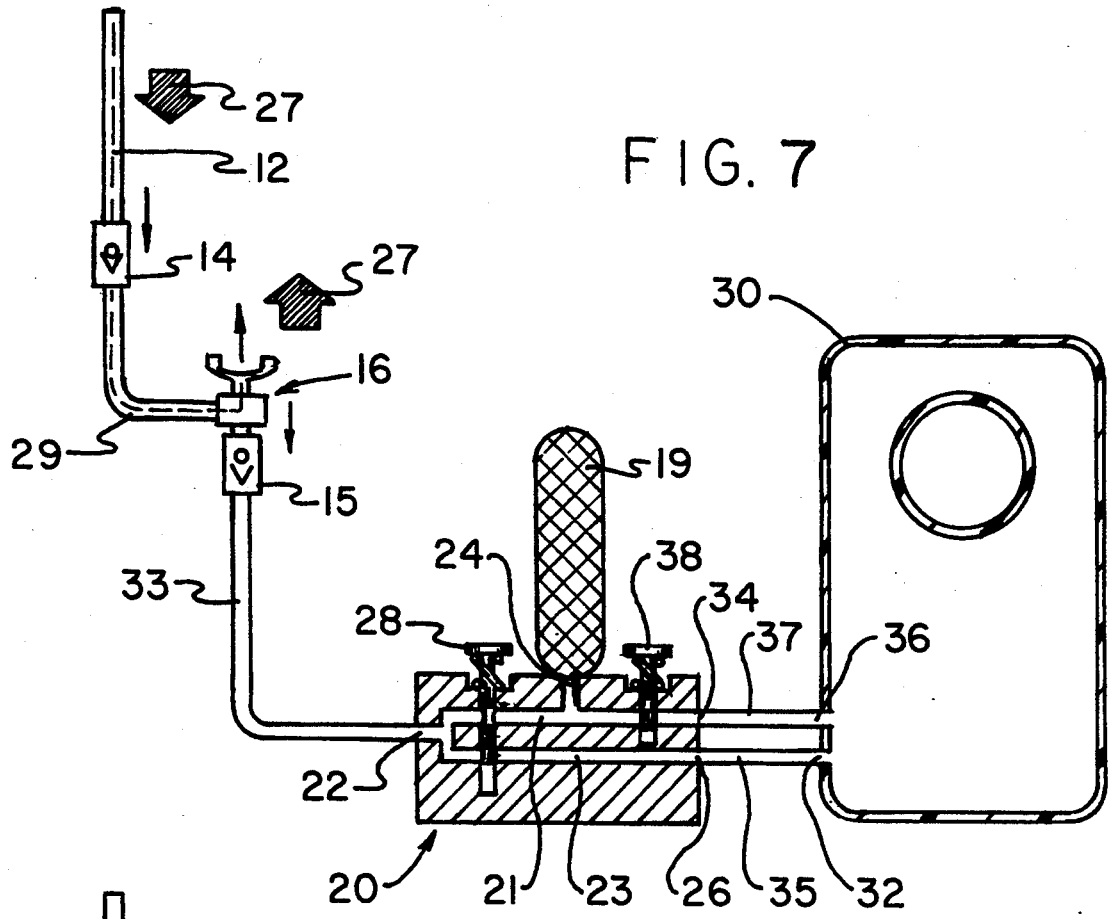
FIG. 7 is an air flow diagram for the embodiment shown in FIG. 5 in a mode wherein air is being inhaled by a snorkeler.
Figure 8:
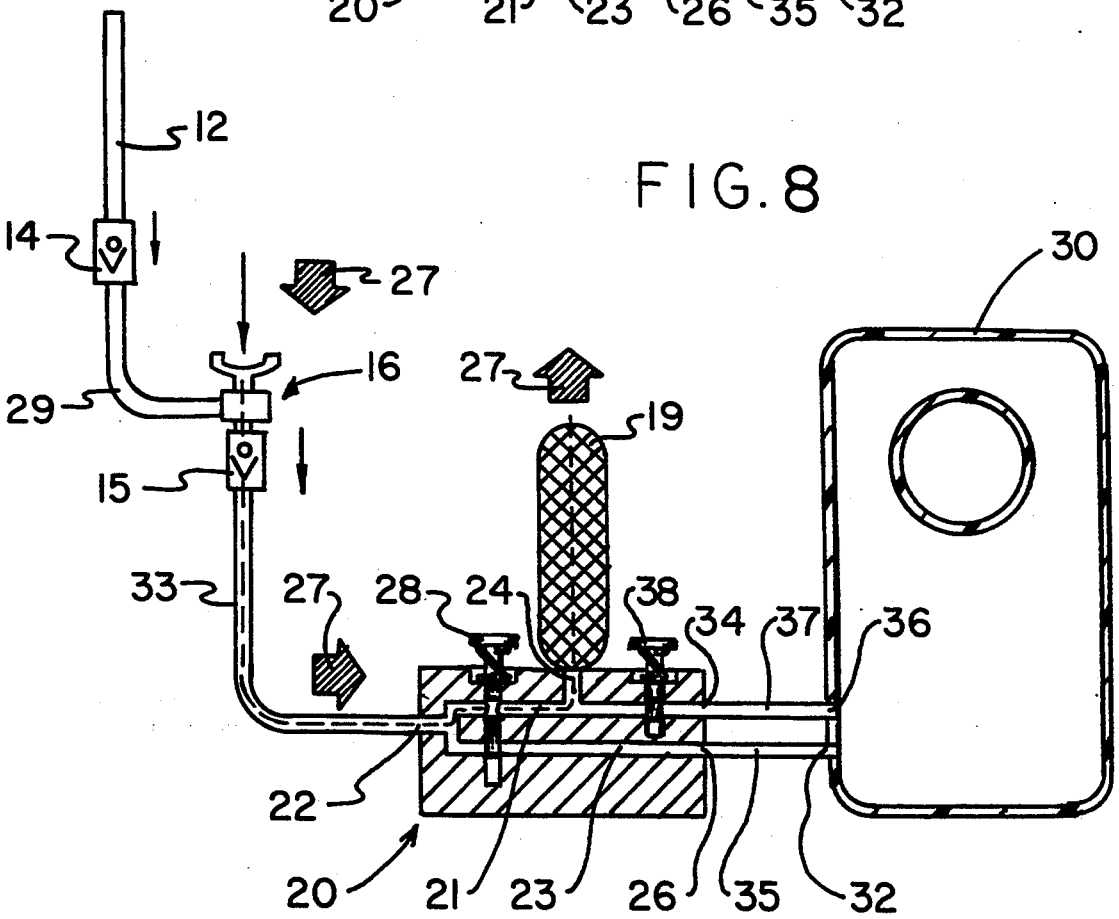
FIG. 8 is an air flow diagram for the embodiment shown in FIG. 5 in a mode wherein air is being exhaled by a snorkeler.
Figure 9:
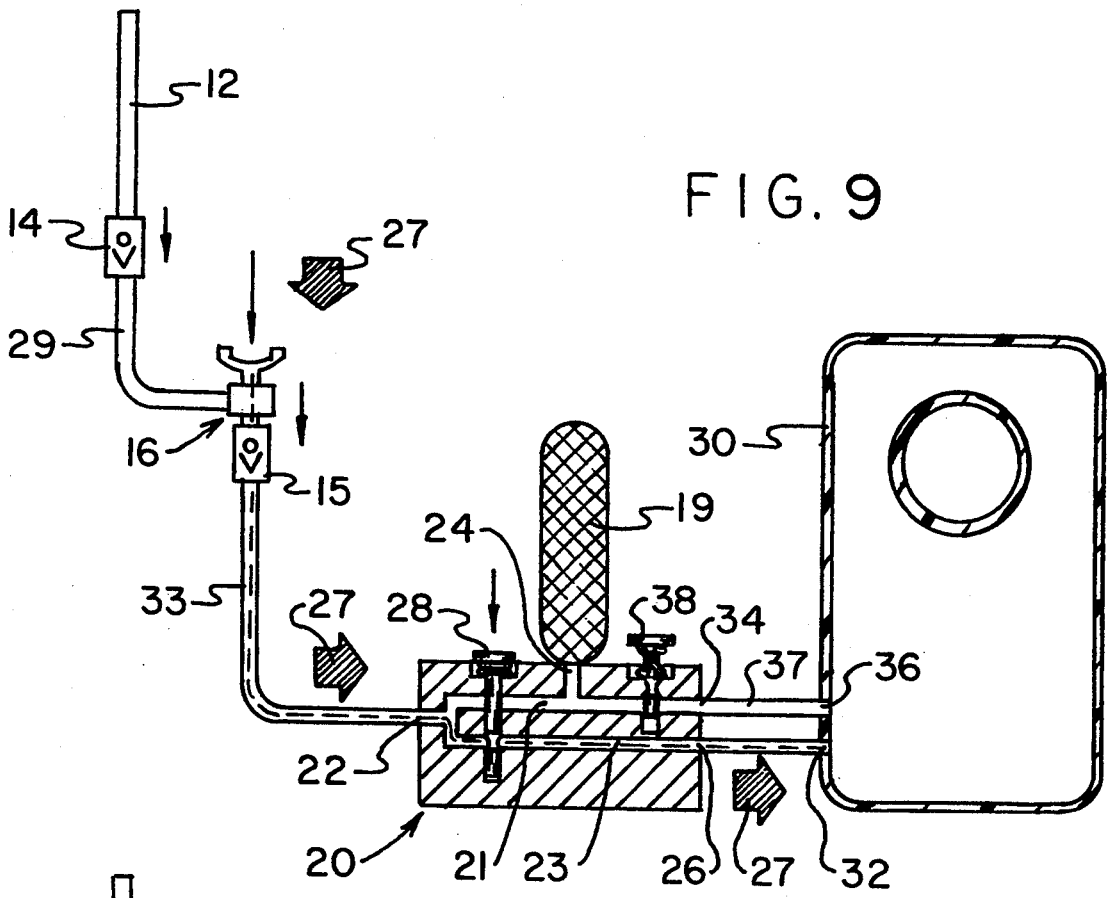
FIG. 9 is an air flow diagram for the embodiment shown in FIG. 5 in a mode wherein air is being exhaled by a snorkeler and is being used to inflate a buoyancy control vest.
Figure 10:
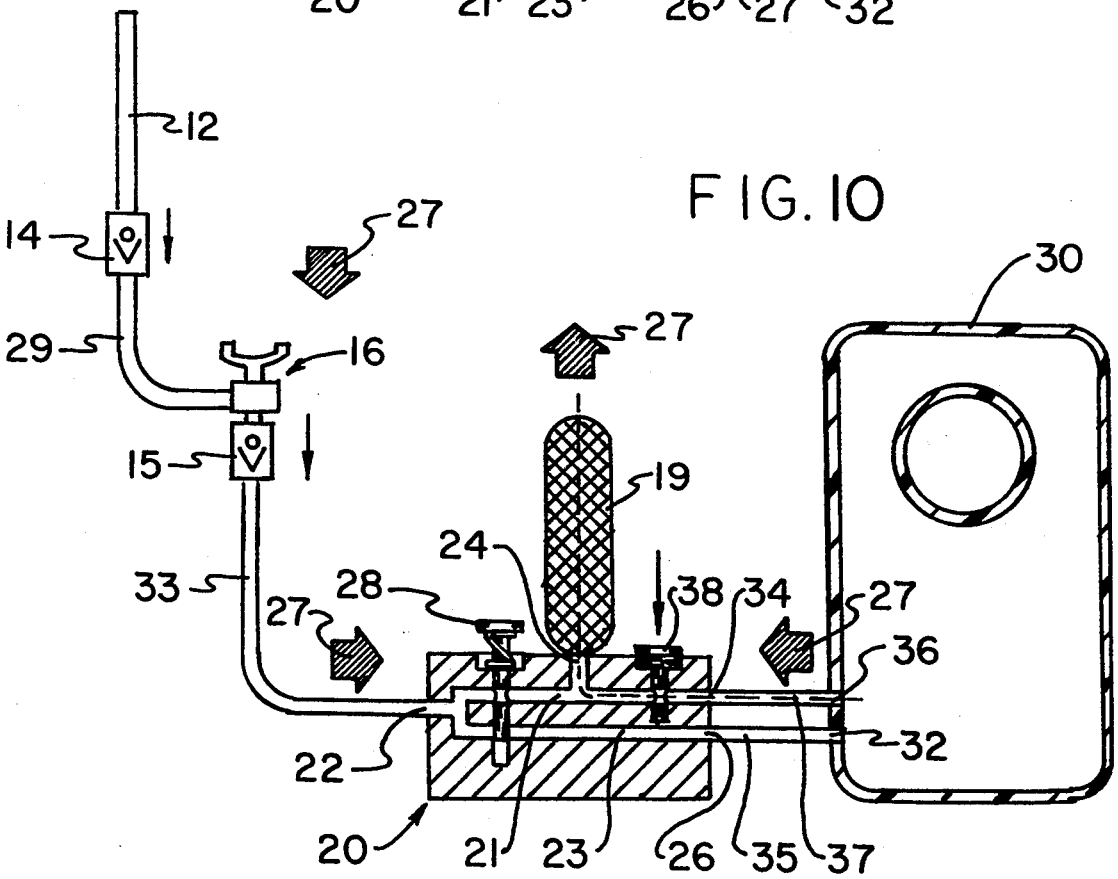
FIG. 10 is an air flow diagram for the embodiment shown in FIG. 5 in a mode wherein air may be exhaled by a snorkeler and the buoyancy control vest is being deflated.

With respect to the first manually actuated output port selector 28, in FIGS. 7, 8, and 10, the first manually actuated output port selector 28 is shown permitting air flow through channel 21, but blocking air flow through channel 23. In FIG. 9, the first manually actuated output port selector 28 blocks air flow in channel 21, but permits air flow in channel 23.

With respect to the second manually actuated output port selector 38, in FIGS. 7, 8, and 9, the second manually actuated output port selector 38 blocks air flow from the second port 36 of the buoyancy control vest 30 to the vent 19 through air channel 21. In FIG. 10, the second manually actuated output port selector 38 permits air to flow from the second port 36 of the buoyancy control vest 30 to the vent 19 through air channel 21, whereby the buoyancy control vest 30 is deflated.

In FIGS. 7–10, direction of air flow is indicated by the large arrows 27. Air flow is also indicated by the dashed lines inside respective air conduits.

More specifically, as shown in FIG. 7, air is being inhaled by the snorkeler.

More specifically, as shown in FIG. 8, air is being exhaled by the snorkeler, and the exhaled air is being passed out the vent 19.

In both FIGS. 7 and 8, the state of inflation of the buoyancy control vest 30 is maintained.

More specifically, as shown in FIG. 9, air is being exhaled by the snorkeler, and the exhaled air is being directed to the buoyancy control vest 30 for inflation thereof.

More specifically, as shown in FIG. 10, air is being released from the buoyancy control vest 30, and the released air is being vented through the vent 19. In FIG. 10, the snorkeler can be either inhaling, exhaling, or holding one's breath.

The components of the snorkel and buoyancy control apparatus of the invention can be made from inexpensive and durable plastic, metal, and rubber materials.

It is apparent from the above that the present invention accomplishes all of the objects set forth by providing a new and improved snorkel and buoyancy control apparatus that is low in cost, relatively simple in design and operation, and which may advantageously be used by a snorkeler to inflate a buoyancy control vest without requiring the snorkeler to remove the snorkel from his/her mouth. Also, with the invention, a person is permitted to inflate the buoyancy control vest without treading water with the snorkel out of the mouth. With the invention, a snorkeler is enabled to change the inflation of the buoyancy control vest during the snorkeling operation. With the invention, inflation of a buoyancy control vest is enabled without direct mouth contact on the vest. With the invention, inflation of a buoyancy control vest is enabled without employing a pressurized tank such as used in scuba diving equipment.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by LETTERS PATENT of the United States is as follows:

1. A new and improved snorkel and buoyancy control apparatus for a snorkeler, said apparatus comprising:

a snorkel tube for receiving inhaled air, a first one-way air valve connected to said snorkel tube for permitting air flow into said snorkel tube during inhalation, a mouthpiece for receiving inhaled air and for supplying the inhaled air to the snorkeler's mouth and lungs, said mouthpiece including a mouthpiece output port for permitting exhaled air to exit from the snorkeler's mouth, a second one-way air valve, connected to said mouthpiece for permitting air flow from said mouthpiece to a selector valve assembly, a selector valve assembly, connected to said mouthpiece by way of said second one-way air valve, for receiving exhaled air from said mouthpiece and for selectively directing exhaled air to either a vent or to a buoyancy control vest, and a buoyancy control vest which includes a first port connected to said selector valve assembly.

2. The apparatus described in claim 1 wherein:

said mouthpiece includes a mouthpiece input port connected to said snorkel tube by way of said first one-way air valve, for receiving inhaled air and for supplying the inhaled air to the snorkeler's mouth and lungs, and said mouthpiece also includes a mouthpiece output port for permitting exhaled air to exit from the snorkeler's mouth.

3. The apparatus described in claim 1 wherein said second one-way air valve is connected to said mouthpiece output port, for permitting air flow from said mouthpiece output port to said selector valve assembly.

4. The apparatus described in claim 1 wherein said selector valve assembly is connected to said mouthpiece output port by way of said second one-way air valve, for receiving exhaled air from said mouthpiece.

5. The apparatus described in claim 1 wherein said selector valve assembly includes a selector valve input port, a first selector valve output port, a second selector valve output port, and a first manually actuated output port selector, wherein said selector valve input port is connected to said mouthpiece output port by way of said second one-way air valve, wherein said first selector valve output port is vented to outside said selector valve assembly through a vent, and wherein said second selector valve output port is connected to said buoyancy control vest.

6. The apparatus described in claim 5 wherein said buoyancy control vest includes a first port connected to said second selector valve output port.

7. A new and improved snorkel and buoyancy control apparatus for a snorkeler, said apparatus comprising:

a snorkel tube for receiving inhaled air, a first one-way air valve connected to said snorkel tube for permitting air flow into, but not back out of, said snorkel tube during inhalation, a mouthpiece, including a mouthpiece input port connected to said snorkel tube by way of said first one-way air valve, for receiving inhaled air and for supplying the inhaled air to the snorkeler's mouth and lungs, and said mouthpiece also including a mouthpiece output port for permitting exhaled air to exit from the snorkeler's mouth, a second one-way air valve, connected to said mouthpiece output port, for permitting air flow from said mouthpiece output port to a selector valve assembly, a selector valve assembly, connected to said mouthpiece output port by way of said second one-way air valve, for receiving exhaled air from said mouthpiece, said selector valve assembly including a selector valve input port, a first selector valve output port, a second selector valve output port, and a first manually actuated output port selector, wherein said selector valve input port is connected to said mouthpiece output port by way of said second one-way air valve, wherein said first selector valve output port is vented to outside said selector valve assembly through a vent, and wherein said second selector valve output port is connected to a buoyancy control vest, a buoyancy control vest which includes a first port connected to said second selector valve output port.

8. The apparatus described in claim 7 wherein:

said selector valve assembly further includes a third selector valve output port and a second manually actuated output port selector, said buoyancy control vest further includes a second port, wherein said second port is connected to said third selector valve output port, and said second manually actuated output port selector controls flow of air from said buoyancy control vest to said first selector valve output port and said vent for deflating said buoyancy control vest.

* * * * *